US005784679A

United States Patent [19]

Schlueter, Jr. et al.

[11] Patent Number: 5,784,679

[45] Date of Patent: Jul. 21, 1998

[54] APPARATUS FOR DRYING AND PRESSING AN IMAGE TO A COPY SHEET

[75] Inventors: Edward L. Schlueter, Jr., Rochester; Edward F. Bowler, Jr., Fairport; Henry R. Till, East Rochester; Dexter A. Dyer, Fairport; Christine J. Tarnawskyj, Webster, all of N.Y.

[73] Assignee: Xerox Corporation, Stamford, Conn.

[21] Appl. No.: 829,394

[22] Filed: Mar. 31, 1997

[51] Int. Cl.[6] ..... G03G 15/20

[52] U.S. Cl. ..... 399/335; 399/336

[58] Field of Search ..... 399/320, 122, 399/335–338; 219/216, 653, 656, 678

[56] References Cited

U.S. PATENT DOCUMENTS

| | | | |
|---|---|---|---|
| 3,810,735 | 5/1974 | Moser | 219/216 |
| 4,079,228 | 3/1978 | Moser | 219/216 |
| 4,411,976 | 10/1983 | Landa et al. | 430/114 |
| 4,435,072 | 3/1984 | Adachi et al. | 399/336 |
| 4,538,899 | 9/1985 | Landa et al. | 355/10 |
| 4,708,460 | 11/1987 | Langdon | 355/10 |
| 4,745,432 | 5/1988 | Langdon | 355/3 FU |
| 4,768,057 | 8/1988 | Kumada et al. | 399/336 |
| 4,897,691 | 1/1990 | Dyer et al. | 355/288 |
| 5,038,179 | 8/1991 | Estavoyer et al. | 399/337 |
| 5,521,688 | 5/1996 | Moser | 219/216 |

FOREIGN PATENT DOCUMENTS

| | | |
|---|---|---|
| 56-159675 | 12/1981 | Japan . |
| 58-085462 | 5/1983 | Japan . |

*Primary Examiner*—Arthur T. Grimley
*Assistant Examiner*—Quana Grainger

[57] ABSTRACT

An image drying and fixing apparatus for affixing an image to a copy substrate, wherein a drying oven defining a copy substrate inlet and outlet is provided with a conveyor for advancing the copy substrate through the drying oven, and an image impacting system disposed along the path of travel of the copy substrate for pressing the image onto the copy substrate in image configuration. The image impacting system includes a pair of cooperating roll members forming a nip through which the copy substrate having the image thereon passes, with the image impacting system being selectively positionable along the path of travel of the copy substrate for optimizing the process of affixing the image to the copy substrate. The image drying and fixing apparatus may also include a radiant heating device situated within the drying oven, positioned for radiating thermal energy in the direction of the copy substrate immediately prior to passage of the copy substrate through the copy substrate output.

17 Claims, 2 Drawing Sheets

APPARATUS FOR DRYING AND PRESSING AN IMAGE TO A COPY SHEET

Figure 1:
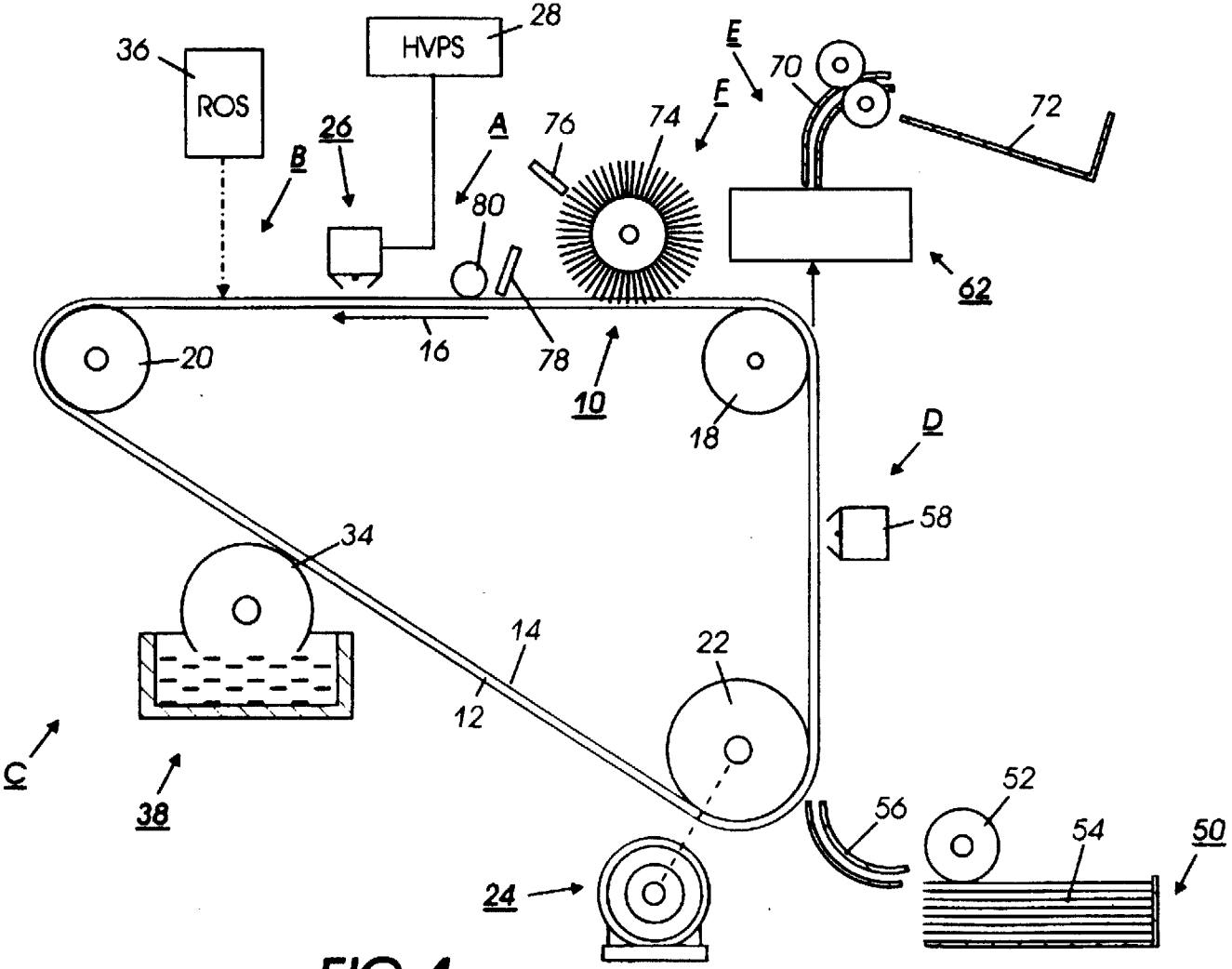

This invention relates to printing systems and, more particularly, concerns an apparatus for drying and fixing an image to a copy sheet in an electrophotographic printing machine.

Generally, the process of electrophotographic printing includes charging a photoconductive member to a substantially uniform potential for sensitizing the surface thereof such that exposure of the charged photoconductive member to a light or electronic image of an original document generates an electrostatic latent image on the surface of the photoreceptor corresponding to the original document. After the electrostatic image is recorded on the photoconductive member, the latent image is developed into a visible image by bringing a developer material into contact with the surface of the photoreceptor. Typically, this developing material comprises carrier granules having toner particles adhering triboelectrically thereto, wherein the toner particles are electrostatically attracted from the carrier granules to the latent image for forming a powder toner image on the photoreceptive member. Alternatively, liquid developing materials have been utilized, comprising marking particles, or so-called toner solids, and charge directors dispersed in a carrier liquid, wherein the liquid developing material is applied to the latent image with the marking particles in the carrier liquid being attracted toward the image areas to form a developed liquid image. Regardless of the type of developing material employed, the toner particles making up the developing material are attracted to the latent image and subsequently transferred from the photoreceptive member to a copy substrate, either directly or by way of an intermediate transfer member. Once transferred to the copy substrate, the image is generally permanently fixed or fused to the substrate to provide a "hard copy" reproduction of the original document or electronic image. In a final step, the photoreceptive member is cleaned to remove any charge and/or residual developing material from the photoconductive surface in preparation for subsequent imaging cycles.

The above described electrostatographic reproduction process is well known and is useful for light lens copying from an original. Analogous processes also exist in printing applications such as, for example, digital laser printing where a latent image is formed on the photoconductive surface via electronically generated or stored image data and a modulated laser beam. Some of these printing processes develop toner on the discharged area, so-called DAD, or "write black" systems, while other printing processes, such as light lens generated image systems, develop toner on the charged areas, so-called CAD, or "write white" systems. In addition to the electrostatographic copying process described above, another well known type of electrostatic imaging process, known as ionographic printing, which involves the use of a dielectric sheet or an electrically insulating web which is transported passed image generating electrodes (or the electrodes may be passed over the insulating web or sheet). The electrodes are selectively energized for depositing an electrostatic charge on the sheet or web to produce a charge pattern thereon in accordance with the potential applied to the electrodes for producing an electrostatic latent image. This electrostatic image may then be developed into visual form by applying developing material to the sheet or web in any conventional manner. The resultant image is then transferred to a final copy substrate, and fused thereto, for permanently affixing the image to the copy substrate. The present invention has equal application to systems which implement either of the described electrostatic printing processes as well as any printing system, electrostatographic or nonelectrostatographic, which requires the fixing or fusing of an image to a copy substrate. In order to permanently fix or fuse a toner image to a copy substrate, it is generally necessary to cause the constituents of the toner material to flow, to some extent, into the fibers of the copy substrate material. This is typically achieved by heating the toner image to a point at which the toner particles become tacky and coalesce. One approach to thermal fusing of toner material images onto the supporting substrate has been to pass the substrate with the unfused toner images thereon between a pair of opposed roller members at least one of which is internally heated. During operation of a fusing system of this type, the support member to which the toner images are electrostatically adhered is moved through the nip formed between the rolls with the toner image contacting the heated fuser roll to thereby effect heating of the toner images within the nip. Typical of such fusing devices are two roll systems wherein the fusing roll is coated with an adhesive material, such as a silicone rubber or other low surface energy elastomer, for example tetrafluorethylene resin sold by E. I. Du Pont de Nemours under the trademark TEFLON™. To further enhance release, a release agent material such as silicone oil is applied to elastomer coating.

The following disclosures may be relevant to various aspects of the present invention.

U.S. Pat. No. 4,411,976

Patentee: Landa et al.

Issued: Oct. 25, 1993

U.S. Pat. No. 4,538,899

Patentee: Landa et al.

Issued: Sep. 3, 1985

U.S. Pat. No. 4,708,460

Patentee: Langdon

Issued: Nov. 24, 1987

U.S. Pat. No. 4,745,432

Patentee: Langdon

Issued: May 17, 1988

U.S. Pat. No. 4,897,691

Patentee: Dyer et al.

Issued: Jan. 30, 1990

U.S. Pat. No. 5,521,688

Patentee: Moser

Issued: May 28, 1996

These disclosures may be briefly summarized as follows:

U.S. Pat. No. 4,411,976 discloses method of transferring a liquid-developed electrostatic image across a gap to a carrier sheet. The method increases the image density and is accomplished by heating the carrier sheet to a temperature at which toner particles solvate in a dispersant liquid.

U.S. Pat. No. 4,538,899 discloses a liquid-developed electrophotographic copier. The developed image which is transferred to a copy sheet is accompanied by a liquid carrier dispersant. The developed imaged is catalytically oxidized to provide harmless gaseous oxidation products. The oxidating temperatures vaporize the liquid carrier to dry and fix the transferred image to the copy sheet.

U.S. Pat. No. 4,708,460 discloses an apparatus that simultaneously transfers and fuses a liquid image composed of liquid carrier and toner particles to a copy sheet. The liquid image is transferred from a photoconductive surface to a chamber having a conveyor belt therein. The copy sheet contacts the conveyor belt to transfer the toner particles thereto. The conveyor belt carriers the sheet to a nip defined by the belt and a heated roller to fuse the toner particles to the sheet and to remove the liquid carrier thereon.

U.S. Pat. No. 4,745,432 discloses a liquid ink fusing system for a reproducing machine having a latent electrostatic image recorded on a photoconductive surface. The latent image is developed with a liquid material composed of a liquid carrier and pigmented particles. The developed image is transferred from the photoconductive surface to a copy sheet. The copy sheet passes through a housing where heat and pressure vaporize the liquid carrier and fuse the pigment particles to the sheet.

U.S. Pat. No. 4,897,691 discloses a reproducing machine having an apparatus for drying and fusing a liquid image to a copy sheet. A flash fuser radiates energy onto the copy sheet to fuse the image to the sheet. A heated roll cooperates with a pressure roll to reheat the copy sheet and vaporize the liquid carrier therefrom after the sheet passes by the flash fuser.

U.S. Pat. No. 5,521,688 discloses an image treatment method and apparatus for fusing color toner images to a substrate such that they exhibit uniform gloss and satisfactory color saturation properties. A substrate carrying color toner images is passed through an oven heater for fixing the color toner images to the substrate. The color images are then passed through the nip of a pair of glossing rolls. The glossing rolls are operated at approximately the fusing temperature provided in the oven fuser.

Although numerous techniques are known in the art for fusing either dry or liquid images, various deficiencies exist with respect to this area of technology. With respect to liquid developing material-based systems in particular, the liquid images produced thereby typically enter the fusing system having a makeup of between 5 and 50 percent solid toner particles and 50 to 95 percent liquid carrier and exit the fusing system with less than 40 percent liquid remaining. In a preferred case, it may be desirable to reduce the liquid content of the image to substantially zero. Fusing techniques and systems designed for use in dry toner machines are generally not capable of sufficiently drying liquid images.

In addition, while high density images (i.e., images having a toner mass greater than 0.5 milligram per square centimeter) formed with liquid developer materials generally fuse well to both smooth and rough copy substrates through the use of conventional drying ovens, liquid images of densities below 0.5 milligram of toner mass per square centimeter become problematic when being fused to rough substrates. Heretofore, techniques and systems which have been utilized for drying liquid images are typically not capable to sufficiently conform the image to copy substrates having relatively rough surfaces, such that the images are not thoroughly and uniformly fused to the substrate.

In today's world, where images are printed on materials ranging from high gloss papers to fabrics and other fibrous materials, it is highly desirable to provide a fusing system that is capable of effectively affixing liquid images to relatively rough copy substrates. The drying and fixing apparatus of the present invention is designed to be compatible with all copy substrates and toner density conditions encountered in liquid image development.

In accordance with one aspect of the present invention, there is provided an image drying and fixing apparatus for affixing an image to a copy substrate, wherein a drying oven having a copy substrate inlet and outlet is provided with a conveyor defining a path of travel for advancing the copy substrate through the drying oven, and an image impacting system disposed along the path of travel of the copy substrate for pressing the image onto the copy substrate in image configuration. The image impacting system includes a pair of cooperating roll members forming a nip through which the copy substrate having the image thereon passes, with the image impacting system being selectively positionable along the path of travel of the copy substrate for optimizing the process of affixing the image to the copy substrate. The image drying and fixing apparatus may also include a radiant heating device situated within the drying oven, positioned for radiating thermal energy in the direction of the copy substrate immediately prior to passage of the copy substrate through the copy substrate output.

Pursuant to another aspect of the present invention, there is provided an electrophotographic printing machine of the type in which an electrostatic latent image is generated on an imaging member, wherein the image is developed into a visible image using developing material and the visible image is subsequently transferred to a copy substrate. In particular, the electrophotographic printing machine comprises: a drying oven including a heated housing having a copy substrate inlet and a copy substrate outlet; a conveyor, disposed at least partially within the housing, defining a path of for advancing the copy substrate through the drying oven; and an image impacting system disposed along the path of travel of the copy substrate for pressing the image onto the copy substrate in image configuration.

In accordance with yet another aspect of the present invention, a printing system is disclosed, comprising: drying means including a heated housing having a copy material inlet and a copy material outlet; conveyor means, disposed at least partially within the housing, defining a path of travel adapted to advance the copy material through the drying means; and image impacting means disposed along the path of travel of the copy material for pressing the image onto the copy material in image configuration.

Figure 2:
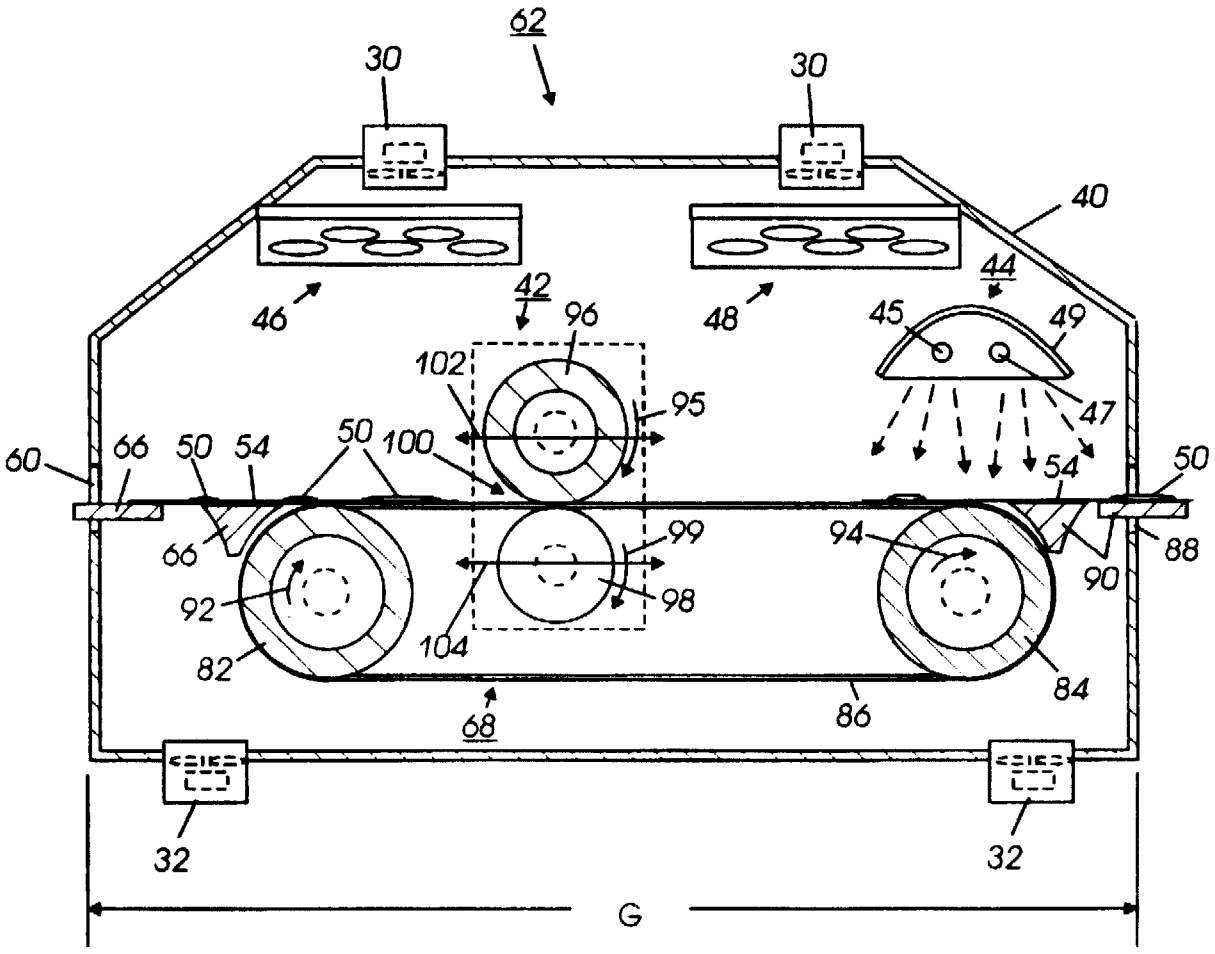

For a general understanding of the features of the present invention, reference is made to the drawings, wherein like reference numerals have been used throughout to designate identical elements. In addition, other aspects of the present invention will become apparent as the following description proceeds and upon reference to the drawings, in which:

FIG. 1 is a schematic, elevational view showing an electrophotographic printing machine incorporating the image drying and fixing apparatus of the present invention; and FIG. 2 is an elevational view depicting the image drying and fixing apparatus of the present invention in greater detail.

Inasmuch as the art of electrostatographic printing is well known, the various processing stations employed in the printing machine of FIG. 1 will be described briefly, prior to describing the invention in detail. As previously indicated, FIG. 1 is a schematic elevational view illustrating an exemplary electrostatographic printing machine incorporating the features of the present invention. In particular, the exemplary machine of FIG. 1 depicts a liquid developing material-based electrostatographic printing system. However, it will be understood that the apparatus of the present invention may be equally well-suited for use in a wide variety of printing machines and is riot necessarily limited in its application to the particular electrostatographic machine described herein. For example, it will be explicitly understood that the method and apparatus of the present invention may find application in a dry toner-type electrostatographic printing machine as well as the described liquid developing material-type electrostatographic printing machine. Moreover, the present invention need not be limited to electrostatographic printing technology as a whole and may find application in any field in which it is desirable to affix an image to a copy substrate. As such, it will be understood that, while the present invention will hereinafter be described in connection with a preferred system and embodiment, the description of the invention is not intended to be limited in its application to this described system or embodiment. On the contrary, the description is intended to cover all alternatives, modifications, and equivalents as may be included within the spirit and scope of the invention as defined by the appended claims.

Referring now to FIG. 1, the illustrative electrophotographic printing machine incorporating the drying and fixing apparatus of the present invention incorporates a photoreceptor 10 in the form of a belt having a photoconductive surface layer 12 on an electroconductive substrate 14. The belt is driven, via motor 24, along a curvilinear path defined by rollers 18, 20 and 22 in a counter-clockwise direction, as indicated by arrow 16.

Initially, a portion of the belt 10 passes through a charge station A where a high voltage power supply 28 is coupled to the corona generator 26. The corona generator 26 charges surface 12 to a relatively high, substantially uniform, potential.

Next, the charged portion of photoconductive surface 12 is advanced through exposure station B. At exposure station B, ROS (Raster Output Scanner) 36 and a RIS (Raster Input Scanner), not shown, are used to expose the charged portions of photoconductive surface 12 for recording an electrostatic latent image thereon. The RIS contains document illumination lamps, optics, a mechanical scanning mechanism and photosensing elements such as charge-coupled device (CCD) arrays. The RIS captures the entire image from the original document and converts it to a series of raster scan lines. These raster scan lines are transmitted from the RIS to the ROS 36. ROS 36 illuminates the charged portion of photoconductive surface 12 with a series of horizontal lines, each line having a specific number of pixels per inch. These lines illuminate the charged portion of the photoconductive surface 12 to selectively discharge the charge thereon. An exemplary ROS 36 includes lasers, rotating polygon mirror blocks, solid state modulator bars and mirrors. It will be understood by those of skill in the art, that various image exposure systems are known in the art and may be adapted for use in the presently described printing system. For example, another type of exposure system may utilize a ROS 36 controlled by the output from an electronic subsystem (ESS) which prepares and manages the image data flow between a computer and the ROS 36. As such, the ESS (not shown) operates as the control electronics for the ROS 36, and may be embodied as a self-contained, dedicated microcomputer. In addition, one skilled in the art will appreciate that a light lens system may be used instead of the RIS/ROS system heretofore described, wherein an original document may be positioned face down upon a transparent platen, whereat light rays are reflected from the original document and transmitted through a lens forming a light image thereof. The lens focuses the light image onto the charged portion of photoconductive surface to selectively dissipate the charge thereon for recording an electrostatic latent image on the photoconductive surface corresponding to the informational areas contained within the original document disposed upon the transparent platen.

After the electrostatic latent image has been recorded on the photoconductive surface 12 of belt 10, belt 10 advances the latent image to a development station C. Development station C includes a developer unit, indicated generally by the reference numeral 38. Developer unit 38 includes a roller 34 adapted to advance liquid developer material into contact with the electrostatic latent image recorded on the photoconductive surface. One skilled in the art will appreciate that a tray having an electrode adjacent the photoconductive belt may also be used to effect development of the latent image with liquid developer material therein. By way of example, the liquid developer material may comprise an insulating liquid carrier material made from an aliphatic hydrocarbon, largely decane, examples of which may include NOPART™ or ISOPAR™, manufactured by the Exxon Corporation. Preferably, toner particles, made predominately from a pigmented material such as a suitable resin which may include carbon black, are dispersed in the liquid carrier. A suitable liquid developer material is described in U.S. Pat. No. 4,582,774, among numerous other patents which exist in the field of developing material technology.

Next, belt 10 advances the developed image to transfer station D. A copy sheet 54 is advanced from tray 50 by roll 52 and guides 56 into contact with the developed image on belt 10. A corona generator 58 sprays ions on the backside of the sheet 54 to attract the toner image from belt 10 to the sheet. As the belt turns around roller 18, the sheet is stripped therefrom with the toner image thereon.

Subsequently, the sheet is advanced by a conveyor (not shown) to fusing station E. Fusing station E includes a fusing system indicated generally by the reference 62. The fuser assembly vaporizes the liquid carrier from the copy sheet and permanently fuses the toner particles in image configuration thereto. The detailed structure of fusing system 62 will be described hereinafter with reference to FIG. 2. After fusing, the sheet advances through chute 70 to catch tray 72 for subsequent removal from the printing machine by a machine operator.

After the sheet is separated from the photoconductive surface of belt 10, some residual liquid developer material typically remains adhering thereto. This residual developer material is removed from the photoconductive surface at cleaning station F. Cleaning station F includes a rotatably mounted fibrous brush 74 formed of any appropriate synthetic resin. Brush 74 may be driven opposite the direction of belt 10 to scrub the photoconductive surface clean. To assist in this action, developing liquid may be fed through pipe 76 onto the surface of brush 74. A doctor blade 78 completes the cleaning of the photoconductive surface. Any residual charge left on the photoconductive surface is extinguished by flooding the photoconductive surface with light from lamp 80.

It is believed that the foregoing description is sufficient for purposes of the present application to illustrate the general operation of an electrophotographic printing machine incorporating the features of the present invention therein.

Moving now to FIG. 2, the image drying and fixing apparatus of the present invention will now be described in greater detail. As depicted thereat, the image drying and fixing apparatus 62 comprises a drying oven 40 in the form of a heated housing, a resin or image impacting system 42, a conveyor 68, and a radiant heater 44. The dimensions of the housing, in particular the length thereof, indicated by dimension G, are governed by various factors including the printing machine process speed as well as the general properties of the developing material making up the image to be fixed. It is envisioned that dimension G can vary from anywhere between approximately 2 feet to greater than 5 feet in length. One skilled in the art will appreciate that dimension G may be reduced by incorporating various additional devices, such as ultra-violet, infra-red, or ultrasonic devices, which may assist in drying the copy substrate.

A copy substrate 54, having an unfused image 50 thereon, enters oven 40 through an entrance passageway 60 and is advanced along a sheet guide member 66 to the conveyor, indicated generally by reference numeral 68. The conveyor 68 includes a pair of spaced rollers 82 and 84 having a belt 86 entrained thereabouts. As can be seen, rollers 82 and 84 are rotated in a clockwise direction, as indicated by arrows 92 and 94, preferably by means of a drive motor (not shown) which is suitably coupled to at least one roller 82 or 84. The conveyor 68 defines a path of travel for advancing the copy sheet 54 through the oven 40 to an exit passageway 88 via guide member 90.

As illustrated in FIG. 2, drying oven 40 includes heating elements 46 and 48 situated in an opposing relationship with copy sheet 54. Initially, the developed image areas 50 on the copy sheet 54 are heated by the heating elements causing the resin and/or pigmented particles of the toner to soften and begin to flow into the copy sheet fibers. In addition, in the case of a liquid image, the heating elements 46 and 48 causes at least a portion of the liquid carrier in the developed image to vaporize. A plurality of upper and lower exhaust systems, indicated generally by the reference numerals 30 and 32 direct the vaporized liquid carrier material and excess oven heat away from copy sheet 54.

After the initial heating of the image 50 on the substrate 54, conveyor 68 advances copy sheet 54 toward the to the resin impacting system 42 comprising a pair of opposed pinch rollers 96 and 98 which are rotated in the directions indicated by arrows 95 and 99. As such, belt 86 is transported, together with copy sheet 54 thereon, through a nip 100 defined by rollers 96 and 98 for applying mechanical pressure to the copy sheet to force the resin or pigment particles of the developed image 50 into the fibers of the copy sheet 54. The mechanical contact pressure applied between the rollers 96 and 98 may be generated by urging the two rollers against one another or merely from the weight of the upper roller disposed in contact with the lower roller. While the pinch rollers 96 and 98 are shown in FIG. 2 to be situated so as to contact the copy substrate while the copy substrate is being transported on the conveyor belt, it will be appreciated that the pinch rollers may be positioned separate from the conveyor system such that the copy substrate is sequentially transported from the conveyor to the pinch rollers. At least one of the rollers 96 or 98 making up the resin impacting system may be provided in the form of a heated roll member for supplying additional heat at the contact point between the roller and the image such that the image impacting system provides the simultaneous application of pressure and additional heat to the image and copy substrate. Additional heat enhances the process of forcing the now molten resin or pigmented particles of image 50 to flow into the copy sheet fibers. It will be recognized by one of skill in the art that rollers 96 and 98 are preferably composed of low surface energy materials such as silicone or fluorosilicone, examples of which may be: TEFLON™, VITON™, or KALREZ™, manufactured by E. I. Du Pont de Nemours & Company. In addition, these rollers preferably have a conformable characteristic such that the surface contour thereof may vary depending upon the texture and/or density of the image on the copy sheet. The belt 86 may be provided with a multiplicity of pinholes or other small openings therein in order to achieve a preferred porosity for allowing vapors to escape from the nip 100 and to permit air to flow through the backside of the copy substrate.

In a particularly advantageous feature of the present invention, the rollers 96 and 98 of the image impacting system 42 are selectively moveable along the length of the conveyor 68, as shown by the bidirectional arrows 102 and 104. Through this feature, the position of the impacting system can be manually or automatically adjusted for optimum fusing and/or image drying based on the toner particle density and/or moisture content of the image as well as the texture and/or porosity of the copy sheet, among various factors. For example, in the case of where a low density liquid image has been transferred to a copy sheet having rough and/or absorbent texture characteristics, the liquid carrier component of the image tends to be quickly absorbed into the copy sheet 54 such that the pigmented marking particles making up image areas on the copy substrate tend to separate, creating microvoids in the image to be fixed to the copy substrate. Under these conditions, it has been found that it is preferable to position the image impacting rollers closer to the entrance passageway 60 of oven 40 in order to press the image into the fibers of the copy substrate prior to evaporation of the liquid carrier component thereon. In another example, wherein a high density liquid image is developed on a copy sheet having a smooth, non absorbent texture, the liquid carrier tends to be more slowly absorbed into the copy sheet 54 such that image smear may result from the process of pressing the image into the copy substrate. In this case, it is preferable to evaporate as much of the liquid carrier component prior to pressing the image into the copy sheet. Thus, the image impacting device 42 is positioned near the exit passageway 88 of oven 40 to allow for a longer drying time prior to pressing the image into the copy substrate.

The image drying and fusing system of the present invention may also include an optional radiant heater 44 situated within oven 40 and positioned subsequent to the image impacting rollers 96 and 98. The radiant heater 44 may comprise a pair of infrared quartz lamps 45 and 47 mounted in a reflector assembly 49 for radiating thermal energy on the direction of the copy sheet 54, as indicated generally by a plurality of arrows. This thermal energy provides further drying of the image on copy sheet 54 before the sheet passes out of the oven through exit passageway 88.

In review, an image drying and fixing apparatus for affixing an image to a copy substrate has been disclosed. The image drying and fixing apparatus includes a drying oven defining a copy substrate inlet and outlet and a conveyor having a path of travel adapted to advance the copy substrate through the drying oven. In addition, an image impacting system is disposed within the drying oven, along the path of travel of the conveyor, for pressing the image onto the copy substrate in image configuration. The image impacting system includes a pair of cooperating roll members forming a nip through which the copy substrate having the image thereon passes, with the image impacting system being selectively positionable along the path of travel of the conveyor for optimizing the process of affixing the image to the copy substrate. The image drying and fixing apparatus may also include a radiant heating device situated within the drying oven, positioned for radiating thermal energy in the direction of the copy substrate immediately prior to passage of the copy substrate through the copy substrate output, thereby providing further drying of the image on the copy substrate before the substrate passes out of the drying oven.

It is, therefore, evident that there has been provided, in accordance with the present invention, an image drying and fixing system that fully satisfies the aims and advantages of the invention as hereinabove set forth. While the invention has been described in conjunction with a preferred embodiment thereof, it is evident that many alternatives, modifications, and variations may be apparent to those skilled in the art. Accordingly, it is intended to embrace all such alternatives, modifications, and variations which may fall within the spirit and broad scope of the appended claims.

We claim:

1. An image drying and fixing apparatus for affixing an image to a copy substrate, comprising a drying oven including a heated housing having a copy substrate inlet and a copy substrate outlet:

a conveyor disposed at least partially within said housing, said conveyor defining a path of travel for advancing the copy substrate through said drying oven; and an image impacting system disposed along the path of travel of the copy substrate for pressing the image onto the copy substrate in image configuration, wherein said image impacting system is selectively positionable along the path of travel of the copy substrate for optimizing the affixing of the image to the copy substrate.

2. The image drying and fixing apparatus of claim 1, further including a radiant heating device situated within said drying oven and positioned for radiating thermal energy in the direction of the copy substrate immediately prior to passage thereof through the copy substrate output.

3. The image drying and fixing apparatus of claim 1, wherein said image impacting system includes:

a pressure roll; and a heated roll cooperating with said pressure roll to form a nip through which the copy substrate having the image thereon passes.

4. The image drying and fixing apparatus of claim 1, wherein said conveyor includes:

a pair of spaced roller members; and a porous belt member entrained about said pair of spaced rollers, defining a path of travel of the conveyor.

5. The image drying and fixing apparatus of claim 1, wherein said drying oven includes at least two heaters placed in an opposing relationship with the sheet of support material to heat the housing.

6. The image drying and fixing apparatus of claim 1, wherein said drying oven includes an exhaust system for removing a substantial portion of heated air and vaporized gases which may be generated within the housing.

7. An electrophotographic printing machine of the type in which an electrostatic latent image is generated on an imaging member, wherein the image is developed into a visible image using developing material and the visible image is subsequently transferred to a copy substrate, said printing machine comprising:

a drying oven including a heated housing having a copy substrate inlet and a copy substrate outlet;

a conveyor, disposed at least partially within said housing, said conveyor defining a path of travel adapted to advance the copy substrate through said drying oven; and an image impacting system disposed along the path of travel of the copy substrate for pressing the image onto the copy substrate in image configuration, wherein said image impacting system is selectively positionable along the path of travel of the copy substrate for optimizing the affixing of the image to the copy substrate.

8. The electrophotographic printing machine of claim 7, wherein said image drying and fixing apparatus further includes a radiant heating device situated within said drying oven and positioned for radiating thermal energy in the direction of the copy substrate immediately prior to passage thereof through the copy substrate output.

9. The electrophotographic printing machine of claim 7, wherein said image impacting system includes:

a pressure roll; and a heated roll cooperating with said pressure roll to form a nip through which the copy substrate having the image thereon passes.

10. The electrophotographic printing machine of claim 7, wherein said conveyor includes:

a pair of spaced roller members; and a porous belt member entrained about said pair of spaced rollers, defining a path of travel for the conveyor.

11. The electrophotographic printing machine of claim 7, wherein said drying oven includes a heating element placed in an opposing relationship with the copy substrate.

12. The electrophotographic printing machine of claim 7, wherein said drying oven includes an exhaust system for removing a substantial portion of heated air and vaporized gases which may be generated within the housing.

13. A printing apparatus for printing an image onto copy material, comprising:

drying means including a heated housing having a copy material inlet and a copy material outlet;

conveyor means disposed at least partially within said housing, said conveyor means defining a path of travel for advancing the copy material through said drying means; and image impacting means disposed along the path of travel of the copy material for pressing the image onto the copy material in image configuration, wherein said image impacting means is selectively positionable along the path of travel of the copy material for optimizing the process of affixing the image to the copy substrate.

14. The printing apparatus of claim 13, further including radiant heating means situated within said drying oven and positioned for radiating thermal energy in the direction of the copy material immediately prior to passage thereof through the copy material output.

15. The printing apparatus of claim 13, wherein said image impacting means further includes:

a pressure roll; and a heated roll cooperating with said pressure roll to form a nip through which the copy material having the image thereon passes.

16. The printing apparatus of claim 13, wherein conveyor means further includes:

a pair of spaced roller members; and a porous belt member entrained about said pair of spaced rollers, defining a path of travel for said conveyor means.

17. The printing apparatus of claim 13, wherein said drying means includes:

a heating element situated within the housing and placed in an opposing relationship with the copy material passing therethrough; and exhaust means for removing a substantial portion of heated air and vaporized gases which may be generated within the housing.

* * * * *